US009936542B2

(12) United States Patent
Middleton

(10) Patent No.: US 9,936,542 B2
(45) Date of Patent: Apr. 3, 2018

(54) MICROWAVE ENERGY INTERACTIVE STRUCTURE WITH VENTING MICROAPERTURES

(75) Inventor: Scott W. Middleton, Oshkosh, WI (US)

(73) Assignee: Graphic Packaging International, LLC, Atlanta, GA (US)

( * ) Notice: Subject to any disclaimer, the term of this patent is extended or adjusted under 35 U.S.C. 154(b) by 1706 days.

(21) Appl. No.: 12/480,892

(22) Filed: Jun. 9, 2009

(65) Prior Publication Data

US 2009/0302032 A1 Dec. 10, 2009

Related U.S. Application Data

(60) Provisional application No. 61/059,885, filed on Jun. 9, 2008.

(51) Int. Cl.

| | |
|---|---|
| ***H05B 6/80*** | (2006.01) |
| ***H05B 6/64*** | (2006.01) |
| ***B65D 81/34*** | (2006.01) |

(52) U.S. Cl.

CPC ..... *H05B 6/6494* (2013.01); *B65D 81/3446* (2013.01); *H05B 6/6408* (2013.01); *B65D 2205/025* (2013.01)

(58) Field of Classification Search

CPC ..... B23B 3/10; B23B 3/26; B23B 3/263
USPC ..... 219/725, 730, 731; 426/107
See application file for complete search history.

(56) References Cited

U.S. PATENT DOCUMENTS

| | | | | |
|---|---|---|---|---|
| 4,268,738 | A | 5/1981 | Flautt, Jr. et al. | |
| 4,283,427 | A | 8/1981 | Winters et al. | |
| 4,703,148 | A | 10/1987 | Mikulski et al. | |
| 4,775,771 | A | 10/1988 | Pawlowski | |
| 4,865,921 | A | 9/1989 | Hollenberg | |
| 4,890,439 | A | 1/1990 | Smart | |
| 4,936,935 | A | 6/1990 | Beckett | |
| 4,943,456 | A | 7/1990 | Pollart et al. | |
| 4,963,424 | A | 10/1990 | Beckett | |
| 5,002,826 | A | 3/1991 | Pollart et al. | |
| 5,039,364 | A | 8/1991 | Beckett et al. | |
| 5,117,078 | A | 5/1992 | Beckett | |
| 5,118,747 | A | 6/1992 | Pollart et al. | |
| 5,170,025 | A | 12/1992 | Perry | |
| 5,213,902 | A * | 5/1993 | Beckett | 428/597 |

(Continued)

FOREIGN PATENT DOCUMENTS

| | | |
|---|---|---|
| JP | 63-66703 | 5/1988 |
| JP | S63-86075 | 6/1988 |

(Continued)

OTHER PUBLICATIONS

US 6,177,664, 01/2001, Cole et al. (withdrawn)

(Continued)

*Primary Examiner* — Dana Ross
*Assistant Examiner* — Ayub Maye
(74) *Attorney, Agent, or Firm* — Womble Bond Dickinson (US) LLP

(57) ABSTRACT

A microwave energy interactive structure comprises a layer of microwave energy interactive material supported on a polymer film. A plurality of microapertures extend through the layer of microwave energy interactive material and the polymer film. The microapertures have a major linear dimension of from about 0.05 mm to about 2 mm.

39 Claims, 2 Drawing Sheets

(56) References Cited

U.S. PATENT DOCUMENTS

| | | | | |
|---|---|---|---|---|
| 5,221,419 | A | 6/1993 | Beckett | |
| 5,260,537 | A | 11/1993 | Beckett | |
| 5,266,386 | A | 11/1993 | Beckett | |
| RE34,683 | E | 8/1994 | Maynard | |
| 5,340,436 | A | 8/1994 | Beckett | |
| 5,354,973 | A | 10/1994 | Beckett | |
| 5,410,135 | A | 4/1995 | Pollart | |
| 5,412,187 | A | 5/1995 | Walters et al. | |
| 5,414,248 | A | 5/1995 | Shelby et al. | |
| 5,424,517 | A | 6/1995 | Habeger | |
| 5,434,393 | A | 7/1995 | Jurkofsky | |
| 5,519,195 | A | 5/1996 | Keefer | |
| 5,530,231 | A | 6/1996 | Walters et al. | |
| 5,628,921 | A | 5/1997 | Beckett | |
| 5,672,407 | A | 9/1997 | Beckett | |
| 5,759,422 | A | 6/1998 | Schmelzer | |
| 5,800,724 | A | 9/1998 | Habeger | |
| 6,068,898 | A * | 5/2000 | Oyama | 428/35.2 |
| 6,114,679 | A | 9/2000 | Lai | |
| 6,150,646 | A | 11/2000 | Lai et al. | |
| 6,204,492 | B1 | 3/2001 | Zeng et al. | |
| 6,251,451 | B1 | 6/2001 | Zeng | |
| 6,414,290 | B1 | 7/2002 | Cole | |
| 6,433,322 | B2 | 8/2002 | Zeng et al. | |
| 6,455,827 | B2 | 9/2002 | Zeng | |
| 6,552,315 | B2 | 4/2003 | Zeng et al. | |
| 6,677,563 | B2 | 1/2004 | Lai | |
| 6,717,121 | B2 | 4/2004 | Zeng | |
| 6,765,182 | B2 | 7/2004 | Cole | |
| 7,019,271 | B2 | 3/2006 | Wnek et al. | |
| 7,351,942 | B2 | 4/2008 | Wnek et al. | |
| 2001/0032843 | A1 | 10/2001 | Aronsson et al. | |
| 2003/0000948 | A1 | 1/2003 | Cole et al. | |
| 2004/0023000 | A1 | 2/2004 | Young et al. | |
| 2004/0062839 | A1 | 4/2004 | Pedersen | |
| 2004/0234653 | A1 * | 11/2004 | Cogley et al. | 426/107 |
| 2006/0049190 | A1 | 3/2006 | Middleton | |
| 2006/0289519 | A1 | 12/2006 | Sharp | |
| 2007/0221666 | A1 | 9/2007 | Keefe | |
| 2007/0251942 | A1 | 11/2007 | Cole et al. | |
| 2007/0275136 | A1 | 11/2007 | Hopkins, Sr. | |
| 2008/0035634 | A1 | 2/2008 | Zeng et al. | |
| 2008/0078759 | A1 | 4/2008 | Wnek et al. | |
| 2008/0245787 | A1 | 10/2008 | Lambert et al. | |
| 2010/0012651 | A1 | 1/2010 | Dorsey | |
| 2010/0059511 | A1 | 3/2010 | Gowens et al. | |
| 2010/0193509 | A1 | 8/2010 | Fitzwater | |
| 2010/0270294 | A1 | 10/2010 | Lafferty | |

FOREIGN PATENT DOCUMENTS

| | | | | |
|---|---|---|---|---|
| JP | 2-128838 | | 5/1990 | |
| JP | 4-83132 | | 7/1992 | |
| JP | 5-24581 | | 3/1993 | |
| JP | 3039410 | | 4/1997 | |
| JP | 10-147381 | | 6/1998 | |
| JP | H11-301743 | | 11/1999 | |
| JP | 2000-30854 | | 1/2000 | |
| JP | 2000030854 | A * | 1/2000 | H05B 6/74 |
| JP | 2001-348075 | | 12/2001 | |
| JP | 2001348075 | A * | 12/2001 | B65D 81/34 |
| WO | WO 2005/068322 | A1 | 7/2005 | |
| WO | WO 2007/127371 | A2 | 11/2007 | |
| WO | WO 2007/146650 | A2 | 12/2007 | |
| WO | WO 2009/152120 | A2 | 12/2009 | |
| WO | WO 2010/129205 | A2 | 11/2010 | |

OTHER PUBLICATIONS

International Search Report and Written Opinion dated Nov. 26, 2010 from PCT/US2010/032336.

International Search Report and Written Opinion—PCT/US2009/046683.

Notification of Reason for Refusal for JP Application No. 2011-513622 dated Jul. 11, 2012 with English translation.

International Preliminary Report on Patentability—PCT/US2009/046683, dated Dec. 13, 2010, Graphic Packaging International, Inc.

International Preliminary Report on Patentability—PCT/US2010/032336, dated Nov. 1, 2011, Graphic Packaging International, Inc.

JP Application No. 2011-513622, Notification of Reason for Refusal, dated Jul. 11, 2012 (with partial translation).

Notice of Allowance and Fee(s) Due for U.S. Appl. No. 12/766,983 dated Oct. 11, 2013.

Notification of Reason for Refusal for JP 2013-092027 dated Feb. 25, 2014.

Notification of Reason for Refusal for JP 2012-508558 dated Jun. 25, 2013.

Supplementary European Search Report for EP 09 76 3411 dated Jan. 8, 2015.

Supplementary European Search Report for EP 10772476.7 dated Jun. 3, 2013.

* cited by examiner

MICROWAVE ENERGY INTERACTIVE STRUCTURE WITH VENTING MICROAPERTURES

CROSS-REFERENCE TO RELATED APPLICATION

This application claims the benefit of U.S. Provisional Application No. 61/059,885, filed Jun. 9, 2008, which is incorporated by reference herein in its entirety.

BACKGROUND

Venting apertures often are used in microwave energy interactive packages to allow moisture to be carried away from a food item that is desirably browned and/or crisped. However, such venting apertures generally comprise physical holes that are mechanically punched or cut through the structure. The minimum size of the hole is dictated by the mechanical process used to form the hole. Unfortunately, when such holes extend through a susceptor, the relatively large holes reduce the effective heating area of the susceptor, and therefore, may cause the browning and/or crisping of the food item to be less uniform. Further, the holes also allow free passage of air and contaminants and therefore may reduce the shelf life of the food item.

Thus, there remains a need for a microwave energy interactive structure that includes at least one aperture that allows moisture to be vented away from the food item during heating without substantially diminishing the ability of the structure to convert microwave energy to sensible heat.

SUMMARY

This disclosure is directed generally to a microwave energy interactive structure, package, or other construct for heating, browning, and/or crisping a food item in a microwave oven, and methods of making and using such a structure, package, or other construct. More particularly, the present disclosure is directed generally to a microwave energy interactive structure that includes a plurality of microapertures configured to provide venting of moisture and/or exudates away from the food item, while not adversely affecting the performance of the microwave energy interactive elements within the structure. As a result, the heating, browning, and/or crisping of the food item may be enhanced significantly.

The microapertures may have any suitable size and arrangement, depending on the need for venting. In some applications, the microapertures generally may have a major linear dimension (e.g., a diameter) of from about 0.05 mm to about 2 mm, for example, from about 0.1 mm to about 0.3 mm. The microapertures may be formed using any suitable process or technique, and in one example, the microapertures are formed using a laser "drilling" process.

The structure may be used to form various wraps, sleeves, pouches, cartons, containers, or other packages (collectively "packages" or "constructs") for containing a food item. If desired, the microapertures may be positioned to provide venting for a particular portion of a package, for example, where the package is divided into compartments and the food item(s) in a particular compartment would benefit from venting. Alternatively or additionally, the microapertures may be positioned to provide venting to a particular portion of a food item, for example, the crust of a dough-based food item. Further still, the microapertures may be used to define a package opening feature that allows the food item to be accessed more readily.

The structure may include one or more microwave energy interactive elements that alter the effect of microwave energy on an adjacent food item. Each microwave interactive element comprises one or more microwave energy interactive materials or segments arranged in a particular configuration to absorb microwave energy, transmit microwave energy, reflect microwave energy, or direct microwave energy, as needed or desired for a particular microwave heating construct and food item. The microwave energy interactive element may be configured to promote browning and/or crisping of a particular area of the food item, to shield a particular area of the food item from microwave energy to prevent overcooking thereof, or to transmit microwave energy towards or away from a particular area of the food item. In one example, the microwave interactive element comprises a susceptor. However, other microwave energy interactive elements may be used.

Other features, aspects, and embodiments of the invention will be apparent from the following description and accompanying figures.

BRIEF DESCRIPTION OF THE DRAWINGS

The description refers to the accompanying drawings, in which like reference characters refer to like parts throughout the several views, and in which.

DESCRIPTION

Various aspects of the disclosure may be illustrated by referring to the figures. For purposes of simplicity, like numerals may be used to describe like features. It will be understood that where a plurality of similar features are depicted, not all of such features necessarily are labeled on each figure. Although several different exemplary aspects, implementations, and embodiments are provided, numerous interrelationships between, combinations thereof, and modifications of the various inventions, aspects, implementations, and embodiments are contemplated hereby.

Figure 1:
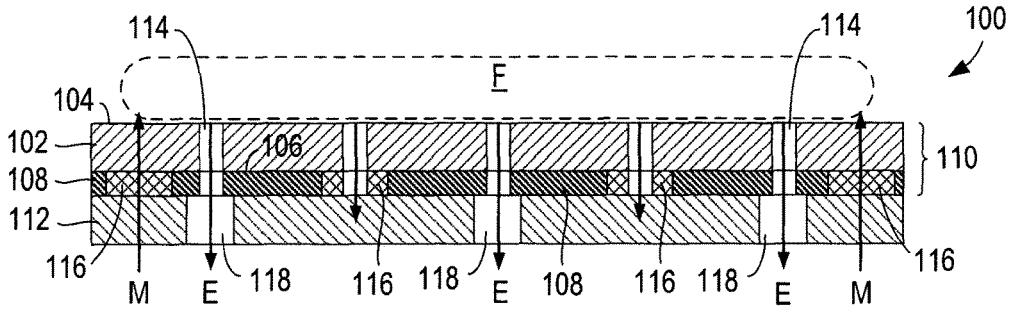
FIG. 1 is a schematic cross-sectional view of a microwave energy interactive structure including a plurality of microapertures.

FIG. 1 schematically depicts an exemplary microwave energy interactive structure 100. The structure 100 includes a substrate 102, for example, a polymer film, having a first side 104 and a second side 106 opposite one another. The first side 104 of the polymer film 102 may be a food-contacting side of the structure 100 to be positioned adjacent to a food item F (shown schematically with dashed lines). A layer of microwave energy interactive material 108 (or "susceptor") is disposed or supported on the second side 106 of the polymer film 102 to collectively define a susceptor film 110. The susceptor 108 is generally less than about 100 angstroms in thickness, for example, from about 60 to about 100 angstroms in thickness) and tends to absorb at least a portion of impinging microwave energy and convert it to thermal energy (i.e., heat) at the interface with the food item. However, other microwave energy interactive elements may be used, as will be discussed further below.

The structure 100 also may optionally include a support layer 112 joined to the layer of microwave energy interactive material 108 using an adhesive (not shown) or otherwise. The support layer 112 may comprise a material capable of absorbing fluids, for example, a paper-based material (e.g., paper or paperboard), or may be any other suitable material (e.g., a polymer film).

As shown in FIG. 1, a plurality of microapertures 114 extend through the thickness of the susceptor 108 and polymer film 102, such that the first side 104 of the polymer film 102 (i.e., the first side 104 of the structure 100, and where present, the food item F) is in open communication with the support layer 112. The microapertures 114 may be formed using any suitable process or technique, and in one example, the microapertures are formed using a laser "drilling" process. In such a process, a laser is used to form or cut a bore through all or the portion of the thickness of a structure. Unlike mechanical cutting or punching processes, laser drilling processes typically are capable of forming the bores without producing a "slug" or "chad" of material that requires a costly, inefficient removal step. Further, since there is no strenuous physical manipulation of the structure to remove such chads or slugs, the integrity of the structure is maintained substantially so the structure can be wound onto rolls more easily without wrinkling.

The microapertures 114 may have any suitable dimensions, for example, a major linear dimension (e.g., a diameter) of from about 0.05 mm to about 2 mm. In each of various independent examples, each microaperture may independently have a major linear dimension of from about 0.08 to about 1.5 mm, from about 0.1 to about 1 mm, from about 0.12 mm to about 0.8 mm, from about 0.15 mm to about 0.5 mm, from about 0.17 to about 0.25 mm. In one particular example, the microapertures have a diameter of from about 0.1 mm to about 0.3 mm, for example, about 0.18 mm.

The structure 100 may be used in the form of a sheet or card to heat, brown, and/or crisp a food item. Alternatively, this and other structures may be used to form all or a portion of a package or wrap for enclosing or enwrapping the food item within an interior space, as will be discussed further below. Any of such structures may have additional layers, as needed for a particular application.

To use the structure, the food item F is positioned adjacent to the first side 104 of the polymer film 102, which may underlie and/or overlie the food item. Upon sufficient exposure to microwave energy M (e.g., schematically represented by upwardly pointing arrows in FIGS. 1-2C), the susceptor 108 converts at least a portion of the impinging microwave energy into thermal energy, which then can be transferred to the surface of the food item F to enhance browning and/or crisping. Any water vapor and/or other exudates E (e.g., schematically represented by upwardly pointing arrows in FIGS. 1-2C) released from the food item during heating may be carried away from the food item through the microapertures 114 towards the support layer 112 where the fluids can be absorbed, thereby further enhancing browning and/or crisping of the food item F. It has been discovered that by using microapertures 114 in the structure 100, rather than conventional mechanically formed apertures, a greater number of microapertures, and better distribution of microapertures, can be provided to transport the moisture and/or exudate away from the food item more effectively without significantly adversely affecting the ability of the susceptor 108 to heat, brown, and/or crisp the food item.

Further, it will be noted that in many conventional susceptor structures including a susceptor film joined to a paper layer, venting is achieved by making an aperture through the entire thickness of the structure. If absorbency is needed, a separate absorbent layer may be provided adjacent to the apertured support layer. In sharp contrast, the present inventors have discovered that by using a laser "drilling" process, the microapertures 114 can be formed in the susceptor film 110 only, thereby providing access to the support layer 112. In this manner, the support layer 112 can also serve as an absorbent layer, notably, without having to jeopardize the integrity of the structure 100 with h conventional apertures, and without the need for an additional absorbent layer.

If additional bulk heating is needed, one or more microwave energy transparent areas 116 may be provided in the layer of microwave energy interactive material 108 to allow the passage of microwave energy M through the structure 100. In the example illustrated schematically in FIG. 1, at least some of the microwave energy transparent areas 116 are at least partially in register with the microapertures 114, and in some of such instances, the microwave energy transparent area 116 may surround or circumscribe the microaperture 114 extending through the layer of microwave energy interactive material 108.

Each microwave energy transparent area 116 may have any suitable shape and/or dimensions needed to provide the desired level of microwave energy transmission through the structure 100, and therefore bulk heating of the food item. In one example, at least one microwave energy transparent area 116 has a major linear dimension greater than the major linear dimension of at least one microaperture 114, for example, the respectively adjacent microaperture 114 (where applicable). The microwave energy transparent areas 116 may be formed in any suitable manner, for example, by selectively applying the microwave energy interactive material 108 to the substrate 102, selectively removing the microwave energy interactive material 108, or by chemically deactivating the microwave energy interactive material 108, as will be discussed further below.

If additional venting is needed, the support layer 112 optionally may include one or more conventional holes or apertures 118. If desired, one or more of such apertures 118 may be at least partially in register with the microapertures 114 in the substrate 102 and susceptor layer 108 to facilitate the transport of moisture (i.e., water vapor) and/or other exudates E away from the food item F and the structure 100. Each aperture 118 may have any suitable dimension needed to provide the desired level of venting away from the food item F, and in one example, at least one aperture 118 has a major linear dimension greater than the major linear dimension of at least one microaperture 114, for example, the respectively adjacent microaperture 114 (where applicable). However, other suitable dimensions and arrangements of apertures 118 are contemplated. As indicated above, the apertures 118 may be omitted such that the support layer 112 is not perforated.

The structure 100 of FIG. 1 can be formed in any suitable manner. In one example, the susceptor film 110 is joined to the optionally apertured support layer 112 using an adhesive or otherwise. The first side 104 of the structure 100 then may be exposed to a laser, which is configured to form small holes or microapertures 114 in the susceptor film 110. In some embodiments, at least some of the microapertures 114 may extend somewhat into the support layer 112. In other embodiments, at least some of the microapertures 114 may extend through the entire thickness of the support layer 112.

Figure 2A:
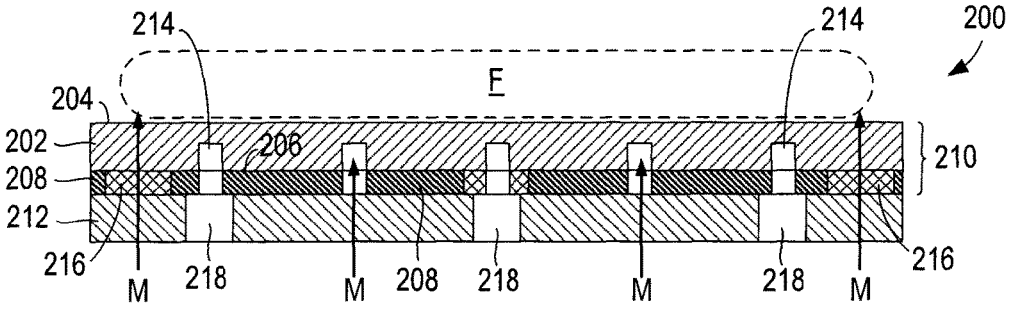
FIG. 2A is a schematic cross-sectional view of yet another microwave energy interactive structure including a plurality of microapertures, before exposure to microwave energy.
Figure 2B:
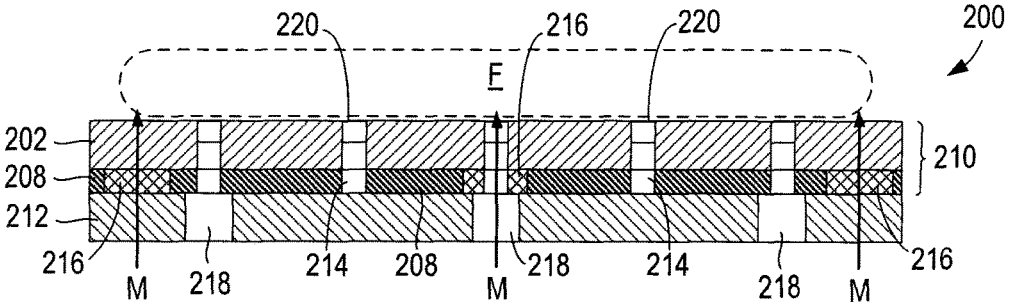
FIG. 2B is a schematic cross-sectional view of the microwave energy interactive structure of FIG. 2A, during exposure to microwave energy.
Figure 2C:
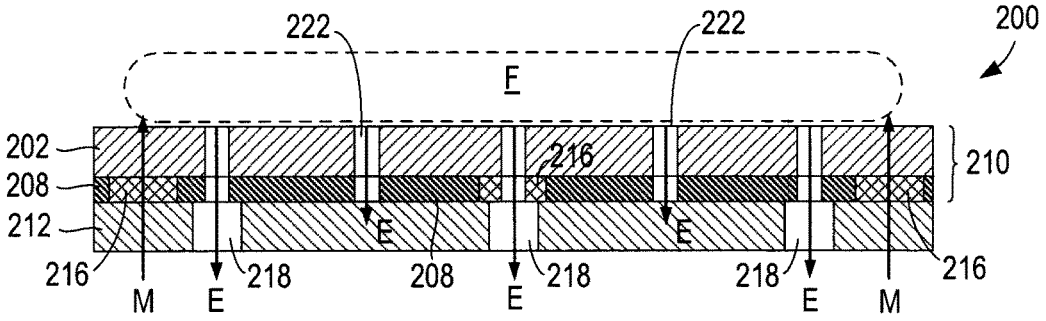
FIG. 2C is a schematic cross-sectional view of the microwave energy interactive structure of FIG. 2B, after sufficient exposure to microwave energy.

FIGS. 2A-2C schematically depict another exemplary microwave energy interactive structure 200. The structure 200 includes features that are similar to the structure 100 shown in FIG. 1, except for variations noted and variations that will be understood by those of skill in the art. For simplicity, the reference numerals of similar features are preceded in the figures with a "2" instead of a "1".

In this example, the microapertures 214 extend through the susceptor 208, but only partially through the thickness of the substrate 202, for example, the polymer film, as shown in FIG. 2A. Upon sufficient exposure to microwave energy, the susceptor 208 converts microwave energy to sensible heat, which causes the polymer film 202 adjacent to the partial microapertures 214 to soften and shrink preferentially, thereby forming a plurality of voids 220 in the polymer film 202, as shown in FIG. 2B. Such voids 220 may be characterized as extensions of the microapertures 214, or may be characterized as voids 220 contiguous with the respective microapertures 214. In either case, each void 220 and the respectively adjacent microaperture 214 collectively define a venting microaperture or channel 222 that extends through the thickness of the structure 200, as shown schematically in FIG. 2C. Such a structure 200 may be suitable for use, for example, to form a package for containing the food item, where a physical barrier is needed to preserve the shelf life of the food item prior to heating (e.g., by preventing the transmission of moisture and/or oxygen into the package), and venting is needed during heating to attain the desired degree of browning and/or crisping of the resulting food item. Upon sufficient exposure to microwave energy M, voids 220 form in the substrate 202 to define the venting apertures 222 capable of carrying moisture and/or other exudates E away from the food item F, as described above.

As with the structure 100 of FIG. 1, if desired, the structure 200 of FIGS. 2A and 2B optionally may include one or more microwave energy transparent areas 216 in the layer of microwave energy interactive material 208 and/or may include one or more apertures 218 in the optional support layer 212. However, it is contemplated that in the embodiment of FIG. 1 and the embodiment of FIGS. 2A and 2B, such features may be omitted. For example, the apertures 218 may be omitted such that the support layer 212 is not perforated. The support layer 212 also may be omitted and, if desired, replaced with one or more other layers.

The structure 200 of FIG. 2A can be formed in any suitable manner. In one example, the susceptor film 210 is exposed to a laser, which is configured to form small holes or microapertures 214 through the layer of microwave energy interactive material 208 and partially into the polymer film 202. The layer of microwave energy interactive material 208 then may be joined to the optionally apertured support layer 212 using an adhesive or otherwise. Other methods are contemplated.

As stated above, structures 100, 200 or numerous others contemplated hereby may be used to form various packages or other constructs. According to another aspect of the disclosure, some or all of the microapertures within the microwave energy interactive structure may serve as a mechanism for opening the package or construct.

Figure 3:
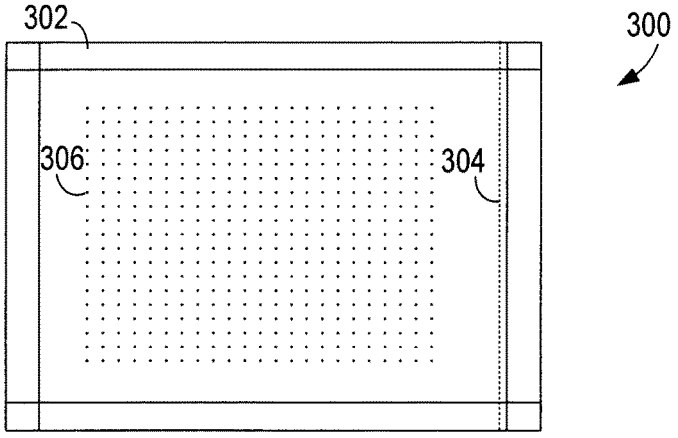
FIG. 3 is a schematic top plan view of an exemplary microwave energy interactive package including a plurality of microapertures.

For example, FIG. 3 schematically illustrates a top plan view of a microwave energy interactive package 300 for heating, browning, and/or crisping a food item. The package 300 may include one or more adjoined panels comprising a microwave energy interactive structure (e.g., structures 100, 200 or numerous others contemplated hereby) that define a cavity or interior space for receiving a food item (not shown). The marginal areas of the sheet(s) or panel(s) may be joined together using edge seals 302 or the like. A first plurality of microapertures defines a line of disruption 304 extending across the package 300 to provide a mechanism for opening the package 300. Such microapertures may extend through all or a portion of the thickness of the material used to form the package, as needed or desired to facilitate opening of the package 300 to access the food item within the interior space. A second plurality of microapertures 306 arranged in a grid pattern provide venting for a food item heated inside the package, as described in connection with FIGS. 1-2B.

Figure 4:
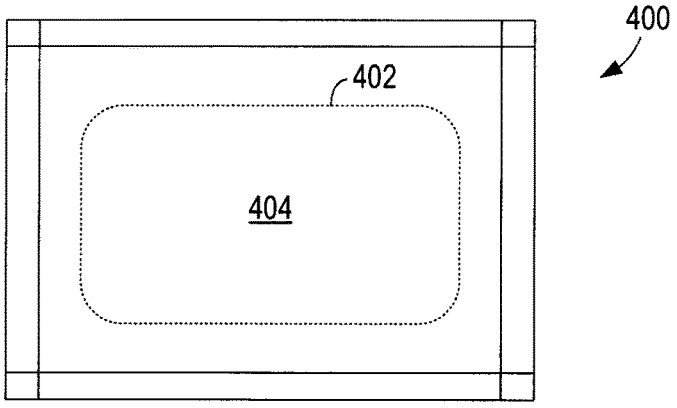
FIG. 4 is a schematic top plan view of another exemplary microwave energy interactive package including a plurality of microapertures.

In another example shown in FIG. 4, the package 400 includes a plurality of microapertures arranged to define a line of disruption 402 that circumscribes a removable panel 404 through which the food item within interior space can be accessed after heating. The microapertures also may provide venting of moisture away from the food item, as described above.

Numerous other packages and constructs having various configurations are contemplated by this disclosure. Furthermore, numerous other microwave energy interactive structures are encompassed by this disclosure. Any of such structures described herein or contemplated hereby may be formed from various materials, provided that the materials are substantially resistant to softening, scorching, combusting, or degrading at typical microwave oven heating temperatures, for example, at from about 250° F. to about 425° F. The particular materials used may include microwave energy interactive materials, for example, those used to form susceptors and other microwave energy interactive elements, and microwave energy transparent or inactive materials, for example, those used to form the substrate, support, and remainder of the structure.

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

While susceptors are illustrated herein, the construct may alternatively or additionally include a foil or high optical density evaporated material having a thickness sufficient to reflect a substantial portion of impinging microwave energy. Such elements are typically formed from a conductive, reflective metal or metal alloy, for example, aluminum, copper, or stainless steel, in the form of a solid "patch" generally having a thickness of from about 0.000285 inches to about 0.05 inches, for example, from about 0.0003 inches to about 0.03 inches. Other such elements may have a thickness of from about 0.00035 inches to about 0.020 inches, for example, 0.016 inches.

Larger microwave energy reflecting elements may be used where the food item is prone to scorching or drying out during heating. Smaller microwave energy reflecting elements may be used to diffuse or lessen the intensity of microwave energy. A plurality of smaller microwave energy reflecting elements also may be arranged to form a microwave energy directing element to direct microwave energy to specific areas of the food item. If desired, the loops may be of a length that causes microwave energy to resonate, thereby enhancing the distribution effect. Microwave energy distributing elements are described in U.S. Pat. Nos. 6,204,492, 6,433,322, 6,552,315, and 6,677,563, each of which is incorporated by reference in its entirety.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The breaks or apertures may extend through the entire structure, or only through one or more layers. The number, shape, size, and positioning of such breaks or apertures may vary for a particular application depending on the type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void (e.g., microapertures 114, 214), in one or more layers or materials used to form the construct, or may be a non-physical "aperture" (e.g., microwave transparent area 116, 216). A non-physical aperture is a microwave energy transparent area that allows microwave energy to pass through the structure without an actual void or hole cut through the structure. Such areas may be formed by simply not applying a microwave energy interactive material to the particular area, or by removing microwave energy interactive material in the particular area, or by chemically and/or mechanically deactivating the microwave energy interactive material in the particular area. It will be noted that chemical deactivation transforms the material in the respective area into a microwave energy transparent (i.e., inactive) substance or material, typically without removing it. While both physical and non-physical apertures allow the food item to be heated directly by the microwave energy, a physical aperture also provides a venting function to allow steam or other vapors to escape from the interior of the construct.

The arrangement of microwave energy interactive and microwave energy transparent areas may be selected to provide various levels of heating, as needed or desired for a particular application. For example, where greater heating is desired, the total inactive (i.e., microwave energy transparent) area may be increased. In doing so, more microwave energy is transmitted to the food item. Alternatively, by decreasing the total inactive area, more microwave energy is absorbed by the microwave energy interactive areas, converted into thermal energy, and transmitted to the surface of the food item to enhance heating, browning, and/or crisping.

In some instances, it may be beneficial to create one or more discontinuities or inactive regions to prevent overheating or charring of the construct. Such areas may be formed by forming these areas of the construct without a microwave energy interactive material, by removing any microwave energy interactive material that has been applied, or by deactivating the microwave energy interactive material in these areas, as discussed above. For example, in the package 300 of FIG. 3, the edge seals 302 may be microwave energy transparent or inactive to prevent charring or disjoining of the sealed sheets or panels.

Further still, one or more panels, portions of panels, or portions of the construct may be designed to be microwave energy inactive to ensure that the microwave energy is focused efficiently on the areas to be heated, browned, and/or crisped, rather than being lost to portions of the food item not intended to be browned and/or crisped or to the heating environment. This may be achieved using any suitable technique, such as those described above.

As stated above, the microwave energy interactive element may be supported on a microwave inactive or transparent substrate 112, 212, for example, a polymer film or other suitable polymeric material, for ease of handling and/or to prevent contact between the microwave energy interactive material and the food item. The outermost surface of the polymer film may define at least a portion of the food-contacting surface of the package (e.g., surface 104, 204 of respective polymer film 102, 202). Examples of polymer films that may be suitable include, but are not limited to, polyolefins, polyesters, polyamides, polyimides, polysulfones, polyether ketones, cellophanes, or any combination thereof. In one particular example, the polymer film comprises polyethylene terephthalate. The thickness of the film generally may be from about 35 gauge to about 10 mil. In each of various examples, the thickness of the film may be from about 40 to about 80 gauge, from about 45 to about 50 gauge, about 48 gauge, or any other suitable thickness. Other non-conducting substrate materials such as paper and paper laminates, metal oxides, silicates, cellulosics, or any combination thereof, also may be used.

Where the polymer film is intended to serve as a barrier layer (e.g., prior to heating), the barrier layer may comprise a polymer film having barrier properties and/or a polymer film including a barrier layer or coating. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier layer may have an oxygen transmission rate (OTR) of less than about 20 cc/m$^2$/day as measured using ASTM D3985. In each of various independent examples, the barrier layer may have an OTR of less than about 10 cc/m$^2$/day, less than about 1 cc/m$^2$/day, less than about 0.5 cc/m$^2$/day, or less than about 0.1 cc/m$^2$/day. The barrier layer may have a water vapor transmission rate (WVTR) of less than about 100 g/m$^2$/day as measured using ASTM F1249. In each of various independent examples, the barrier layer may have a WVTR of less than about 50 g/m$^2$/day, less than about 15 g/m$^2$/day, less than about 1 g/m$^2$/day, less than about 0.1 g/m$^2$/day, or less than about 0.05 g/m$^2$/day.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth.

Various materials may serve as the support layer (or "support") 112, 212 for the construct 100, 200. For example, the support layer may be formed at least partially from a polymer or polymeric material. As another example, support layer may be formed from a paper or paperboard material. In one example, the paper has a basis weight of from about 15 to about 60 lbs/ream (lb/3000 sq. ft.), for example, from about 20 to about 40 lbs/ream. In another example, the paper has a basis weight of about 25 lbs/ream. In another example, the paperboard having a basis weight of from about 60 to about 330 lbs/ream, for example, from about 155 to about 265 lbs/ream. In one particular example, the paperboard has a basis weight of about 175 lbs/ream. The paperboard generally may have a thickness of from about 6 to about 30 mils, for example, from about 14 to about 24 mils. In one particular example, the paperboard has a thickness of about 16 mils. Any suitable paperboard may be used, for example, a solid bleached or solid unbleached sulfate board, such as SUS® board, commercially available from Graphic Packaging International.

The package may be formed according to numerous processes known to those in the art, including using adhesive bonding, thermal bonding, ultrasonic bonding, mechanical stitching, or any other suitable process. Any of the various components used to form the package may be provided as a sheet of material, a roll of material, or a die cut material in the shape of the package to be formed (e.g., a blank).

It will be understood that with some combinations of elements and materials, the microwave energy interactive element may have a grey or silver color that is visually distinguishable from the substrate or the support. However, in some instances, it may be desirable to provide a package having a uniform color and/or appearance. Such a package may be more aesthetically pleasing to a consumer, particularly when the consumer is accustomed to packages or containers having certain visual attributes, for example, a solid color, a particular pattern, and so on. Thus, for example, the present disclosure contemplates using a silver or grey toned adhesive to join the microwave energy interactive element to the support, using a silver or grey toned support to mask the presence of the silver or grey toned microwave energy interactive element, using a dark toned substrate, for example, a black toned substrate, to conceal the presence of the silver or grey toned microwave energy interactive element, overprinting the metallized side of the polymer film with a silver or grey toned ink to obscure the color variation, printing the non-metallized side of the polymer film with a silver or grey ink or other concealing color in a suitable pattern or as a solid color layer to mask or conceal the presence of the microwave energy interactive element, or any other suitable technique or combination of techniques.

The disclosure may be understood further from the following examples, which are not intended to be limiting in any manner.

Example 1

A calorimetry test was conducted to demonstrate the conductivity and maximum temperature of various susceptor structures including a plurality of microapertures as compared with a conventional susceptor without microapertures. The samples with microapertures were prepared on an x-y table using a carbon dioxide laser.

For each structure, a sample having a diameter of about 5 in. was positioned between two circular pyrex plates, each having a thickness of about 0.25 in. and a diameter of about 5 in. A 250 g water load in a plastic bowl resting on an about 1 in. thick expanded polystyrene insulating sheet was placed above the plates (so that radiant heat from the water did not affect the plates). The bottom plate was raised about 1 in. above the glass turntable using three substantially triangular ceramic stands. Thermo-optic probes were affixed to the top surface of the top plate to measure the surface temperature of the plate. After heating the sample at full power for about 5 minutes in a 1300 W microwave oven, the average temperature rise in degrees C. of the top plate surface was recorded. The conductivity of each sample was measured prior to conducting the calorimetry test, with five data points being collected and averaged. The Gurley porosity (air resistance) was also measured (five repetitions) according to TAPPI T 460 om-02 for some samples prior to heating and after heating. The results are presented in Table 1. The samples including the microapertures had a slightly lower, but statistically insignificant, maximum change in temperature.

TABLE 1

| Sample | Description | Delta T Max (° C.) | Conductivity (mmho/sq) | Gurley porosity (s/100 cc) |
|---|---|---|---|---|
| 1 | 48 gauge metallized polyethylene terephthalate (PET) with no apertures adhesively joined to 12 point (pt) paperboard | 146.2 | 11-12 | >1800 before heating 11989 after heating |
| 2 | 48 gauge metallized PET with about 0.18 mm diameter microapertures spaced about 0.5 in. apart in a grid pattern, adhesively joined to 12 pt paperboard | 138.0 | 11-12 | Not tested |
| 3 | 48 gauge metallized PET with about 0.18 mm diameter microapertures spaced about 0.375 in. apart in a grid pattern, adhesively joined to 12 pt paperboard | 145.5 | 11-12 | Not tested |
| 4 | 48 gauge metallized PET with about 0.18 mm diameter microapertures spaced about 0.25 in. apart in a grid pattern, adhesively joined to 12 pt paperboard | 142.6 | 11-12 | Not tested |
| 5 | 48 gauge metallized PET adhesively joined to 12 pt paperboard, with pin-punched apertures spaced about 0.5 in apart through entire thickness* | 145.3 | 11-12 | 6543 before heating 3016 after heating |
| 6 | 48 gauge metallized PET adhesively joined to 12 pt paperboard, with about 4.0 mm diameter punched apertures spaced about 0.5 in. apart through entire thickness* | 144.1 | 11-12 | 8.2 before heating ~0 after heating |

*Samples 5 and 6 were prepared for comparative purposes only and may not be representative of machine-made structures.

The overall pattern of crazing of each sample was also noted. The samples with microapertures (Samples 2-4) exhibited substantially the same pattern of crazing as the control sample (Sample 1), generally indicating that the presence of the microapertures had little or no effect on the behavior of the metallized PET.

Example 2

Various constructs were evaluated to determine their respective ability to heat, brown, and/or crisp a food item. Microwave heating sheets or cards having dimensions of about 3.5 in. by about 7.5 in. were prepared. The samples were used to heat Schwan's flatbread pizzas for about 2 min. in an 1100 W microwave oven. The results are summarized in Table 2.

TABLE 2

| Sample | Description | Results |
|---|---|---|
| 7 | 48 gauge metallized polyethylene terephthalate (PET) adhesively joined to 12 pt paperboard with no apertures (control) | Acceptable browning and crisping; minor oil absorption along peripheral edge |
| 8 | 48 gauge metallized PET adhesively joined to 12 pt paper with about 0.18 mm diameter microapertures spaced about 0.125 in. apart in a grid pattern | Acceptable browning and crisping; substantial oil absorption uniformly across card |
| 9 | 48 gauge metallized PET adhesively joined to 12 pt paper with about 0.18 mm diameter microapertures spaced about 0.25 in. apart in a grid pattern | Acceptable browning and crisping; some oil absorption scattered across card |
| 10 | 48 gauge metallized PET adhesively joined to 12 pt paper with about 0.18 mm diameter microapertures spaced about 0.375 in. apart in a grid pattern | Acceptable browning and crisping; some oil absorption scattered across card |
| 11 | 48 gauge metallized PET adhesively joined to 12 pt paper with about 0.18 mm diameter microapertures spaced about 0.5 in. apart in a grid pattern | Acceptable browning and crisping; some oil absorption scattered across card |

Although all of the samples provided a generally acceptable level of browning and/or crisping, Sample 8 provided the greatest degree of moisture and/or exudate absorption.

While the present invention is described herein in detail in relation to specific aspects and embodiments, it is to be understood that this disclosure is only illustrative and exemplary of the present invention and is made merely for purposes of providing a full and enabling disclosure of the present invention and to set forth the best mode of practicing the invention known to the inventors at the time the invention was made. The disclosure set forth herein is illustrative only and is not intended, nor is to be construed, to limit the present invention or otherwise to exclude any such other embodiments, adaptations, variations, modifications, and equivalent arrangements of the present invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other. Further, various elements discussed with reference to the various embodiments may be interchanged to create entirely new embodiments coming within the scope of the present invention.

What is claimed is:

1. A microwave energy interactive structure comprising:

a layer of microwave energy interactive material supported on a polymer film, wherein the polymer film has opposite first and second sides, the first side of the polymer film is for facing a food item, the microwave energy interactive material has opposite first and second sides, the first side of the microwave interactive material faces toward the second side of the polymer film;

a support layer joined to the second side of the microwave energy interactive material so that the microwave energy interactive material is positioned between the support layer and the polymer film; and a plurality of microapertures extending through the layer of microwave energy interactive material and the polymer film, the microapertures having a major linear dimension of from about 0.05 mm to about 2 mm, a microaperture of the plurality of microapertures having opposite first and second ends, the first end of the microaperture comprising an opening located at the first side of the polymer film, and the support layer extending across the second end of the microaperture so that the second end of the microaperture is obstructed by the support layer, so that the microaperture extends from the first side of the polymer film to the support layer.

2. The structure of claim 1, wherein:

a microwave energy transparent area is positioned in the layer of microwave energy interactive material; and the microaperture is circumscribed by the microwave energy transparent area in the layer of microwave energy interactive material.

3. The structure of claim 1, wherein the first side of the polymer film is in communication with the support layer by way of the microaperture.

4. The structure of claim 1, wherein the support layer comprises paper.

5. The structure of claim 1, wherein the support layer includes a plurality of apertures.

6. The structure of claim 1, wherein the structure is at least a portion of a microwave heating construct having an interior space for receiving a food item.

7. The structure of claim 1, wherein for each microaperture of the plurality of microapertures:

the microaperture has opposite first and second ends, the first end of the microaperture comprises an opening located at the first side of the polymer film, and the second end of the microaperture is obstructed by the support layer, so that the microaperture extends from the first side of the polymer film to the support layer.

8. The structure of claim 3, wherein:

the microaperture is configured for allowing at least one of water vapor and exudates to pass therethrough from the food item to the support layer, and the support layer is operative for absorbing at least one of water vapor and exudates from the food item.

9. The structure of claim 4, wherein at least one aperture in the support layer is in register with a microaperture extending through the layer of microwave energy interactive material and the polymer film.

10. The structure of claim 2, wherein the microaperture extends through the microwave energy transparent area in the layer of microwave energy interactive material.

11. The structure of claim 2, wherein the microwave energy transparent area is at least partially coplanar with the layer of microwave energy interactive material.

12. The structure of claim 6, wherein the microapertures at least partially define a removable portion of the construct.

13. The structure of claim 12, wherein the removable portion of the construct is operative for accessing the food item within the interior space.

14. A microwave energy interactive structure comprising:

a polymer film having a first side and a second side opposite one another, and a thickness between the first side and the second side;

a layer of microwave energy interactive material disposed on the second side of the polymer film; and a plurality of microapertures extending through the layer of microwave energy interactive material and into the second side of the polymer film, the microapertures extending only partially through the thickness of the polymer, the microapertures having a major linear dimension of from about 0.05 mm to about 2 mm.

15. The structure of claim 14, wherein the polymer film serves as a barrier layer.

16. The structure of claim 14, wherein the microwave energy interactive structure is configured for being responsive to microwave energy so that upon sufficient exposure of the microwave energy interactive structure to microwave energy, a plurality of voids automatically form between the microapertures and the first side of the polymer film.

17. The structure of claim 14, wherein:

a microwave energy transparent area is positioned in the layer of microwave energy interactive material; and at least one microaperture of the plurality of microapertures extending through the layer of microwave energy interactive material is circumscribed by the microwave energy transparent area in the layer of microwave energy interactive material.

18. The structure of claim 14, further comprising a support layer joined to the layer of microwave energy interactive material on a side of the layer of microwave energy interactive material opposite the polymer film.

19. The structure of claim 14, wherein the structure is at least a portion of a microwave heating construct having an interior space for receiving a food item.

20. The structure of claim 18, wherein the support layer includes a plurality of apertures.

21. The structure of claim 18, wherein the support layer comprises a paper-based material.

22. The structure of claim 19, wherein the microapertures at least partially define a removable portion of the microwave heating construct.

23. The structure of claim 17, wherein the microwave energy transparent area is at least partially coplanar with the layer of microwave energy interactive material.

24. The structure of claim 20, wherein the plurality of apertures of the support layer includes at least one aperture in register with one of the microapertures extending through the layer of microwave energy interactive material.

25. The structure of claim 22, wherein the removable portion of the microwave heating construct is operative for accessing the food item within the interior space.

26. A microwave energy interactive structure comprising:

a polymer film having a first side and a second side opposite one another, and a thickness between the first side and the second side;

a layer of microwave energy interactive material deposited on the second side of the polymer film;

a plurality of micro apertures extending through the layer of microwave energy interactive material and into the second side of the polymer film, the microapertures extending only partially through the thickness of the polymer; and a support layer joined to the layer of microwave energy interactive material, wherein the microwave energy interactive structure is configured for being responsive to microwave energy so that after sufficient exposure of the microwave energy interactive structure to microwave energy, the microapertures automatically become extended so that the microapertures extend through the layer of microwave energy interactive material and through the thickness of the polymer film, so that the first side of the polymer film is in communication with the support layer by way of the microapertures.

27. The structure of claim 26, wherein the microapertures have a major linear dimension of from about 0.05 mm to about 2 mm.

28. The structure of claim 26, in combination with a food item, wherein the food item has a surface that is desirably at least one of browned and crisped.

29. A method of using the combination of claim 28, comprising positioning the food item on the first side of the polymer film of the structure, so that the surface of the food item is proximate to the layer of microwave energy interactive material, and exposing the food item on the first side of the polymer film of the structure to microwave energy, so that the layer of microwave energy interactive material generates heat and softens the polymer film adjacent to the microapertures, such that the microapertures extend through the layer of microwave energy interactive material and through the thickness of the polymer film.

30. The method of claim 29, wherein after exposing the food item on the first side of the polymer film of the structure to microwave energy, the first side of the polymer film is in communication with the support layer by way of the microapertures, so that the microapertures are operative for carrying moisture away from the food item.

31. A microwave energy interactive structure comprising:

a polymer film having a first side and a second side opposite one another;

a layer of microwave energy interactive material disposed on the second side of the polymer film;

a microwave energy transparent area positioned in the layer of microwave energy interactive material; and a plurality of microapertures extending through the layer of microwave energy interactive material and the polymer film so that the first side of the polymer film is in communication with the layer of microwave energy interactive material by way of the microapertures, the microapertures having a major linear dimension of from about 0.05 mm to about 2 mm, wherein at least one microaperture of the plurality of microapertures extending through the layer of microwave energy interactive material is circumscribed by the microwave energy transparent area in the layer of microwave energy interactive material, wherein the microwave energy transparent area comprises the microwave energy interactive material in a chemically deactivated condition.

32. The structure of claim 31, further comprising a support layer joined to the layer of microwave energy interactive material on a side of the layer of microwave energy interactive material opposite the polymer film, wherein the support layer is operative for absorbing at least one of water vapor and exudates released from the food item.

33. The structure of claim 31, wherein the microapertures at least partially define a removable portion of a microwave heating construct comprising the structure.

34. The structure of claim 31, wherein the microapertures have a major linear dimension of from about 0.08 mm to about 1.5 mm.

35. The structure of claim 31, wherein the microapertures have a major linear dimension of from about 0.15 mm to about 0.5 mm.

36. The structure of claim 31, wherein the microapertures have a major linear dimension of from about 0.1 mm to about 0.3 mm.

37. The structure of claim 31, wherein the microwave energy transparent area is at least partially coplanar with the layer of microwave energy interactive material.

38. The structure of claim 32, wherein the support layer includes a plurality of apertures.

39. The structure of claim 38, wherein the plurality of apertures of the support layer includes at least one aperture in register with one of the microapertures extending through the layer of microwave energy interactive material.

* * * * *